US009386851B2

(12) United States Patent
Dubach

(10) Patent No.: US 9,386,851 B2
(45) Date of Patent: Jul. 12, 2016

(54) ARRANGEMENT FOR MOVING A MOVEABLE FURNITURE PART

(71) Applicant: Julius Blum GmbH, Hoechst (AT)

(72) Inventor: Fredi Dubach, Baeretwil (CH)

(73) Assignee: JULIUS BLUM GMBH, Hoechst (AT)

( * ) Notice: Subject to any disclaimer, the term of this patent is extended or adjusted under 35 U.S.C. 154(b) by 0 days.

(21) Appl. No.: 14/287,576

(22) Filed: May 27, 2014

(65) Prior Publication Data

US 2014/0265782 A1 Sep. 18, 2014

Related U.S. Application Data

(63) Continuation of application No. PCT/AT2012/000264, filed on Oct. 19, 2012.

(30) Foreign Application Priority Data

Dec. 23, 2011 (AT) ..... 1880/2011

(51) Int. Cl.
*A47B 88/04* (2006.01)

(52) U.S. Cl.
CPC ..... *A47B 88/0477* (2013.01); *A47B 88/0481* (2013.01)

(58) Field of Classification Search
CPC ..... A47B 88/047; A47B 88/0477; A47B 88/0481
USPC ..... 312/330.1, 333, 334.1, 334.8, 334.44, 312/319.1, 319.5
See application file for complete search history.

(56) References Cited

U.S. PATENT DOCUMENTS

| | | | | |
|---|---|---|---|---|
| 2007/0101539 | A1 | 5/2007 | Sutterlutti et al. | |
| 2007/0222346 | A1 | 9/2007 | Kleinsasser | |
| 2008/0191592 | A1 * | 8/2008 | Dubach | 312/319.1 |
| 2008/0265732 | A1 * | 10/2008 | Weber | 312/334.1 |

(Continued)

FOREIGN PATENT DOCUMENTS

| | | |
|---|---|---|
| CN | 1988827 | 6/2007 |
| CN | 101068487 | 11/2007 |
| CN | 102106658 | 6/2011 |

(Continued)

OTHER PUBLICATIONS

International Search Report (ISR) issued Feb. 21, 2013 in International (PCT) Application No. PCT/AT2012/000264.

(Continued)

*Primary Examiner* — James O Hansen
(74) *Attorney, Agent, or Firm* — Wenderoth, Lind & Ponack, L.L.P.

(57) ABSTRACT

An arrangement for moving a moveable furniture part has an ejection device for the ejection of the furniture part from the closed position to a first open position, and the ejection device includes a force accumulator. A loading device loads the force accumulator by a closing movement of the furniture part. The loading of the force accumulator is accomplished by a loading path having an end point, and the force accumulator is fully loaded at the end point of the loading path. The loading path has a variable starting point, and the starting point is defined for a closing movement of the furniture part by the position of the furniture part at the beginning of a closing movement from a second open position which is greater than the first open position.

23 Claims, 8 Drawing Sheets

(56) References Cited

U.S. PATENT DOCUMENTS

| | | | | |
|---|---|---|---|---|
| 2009/0072687 | A1* | 3/2009 | Fitz | 312/319.5 |
| 2011/0210653 | A1 | 9/2011 | Salice | |

FOREIGN PATENT DOCUMENTS

| | | |
|---|---|---|
| CN | 102159118 | 8/2011 |
| CN | 102178406 | 9/2011 |
| DE | 1 863 925 | 12/1962 |
| DE | 198 23 305 | 12/1999 |
| EP | 1 215 355 | 6/2002 |
| EP | 1 396 212 | 3/2004 |
| EP | 2 389 837 | 11/2011 |

OTHER PUBLICATIONS

Austrian Patent Office Search Report (ASR) issued Aug. 10, 2012 in Austrian Patent Application No. A 1880/2011.

Chinese Office Action (OA) and Search Report (SR) issued Jun. 10, 2015 in counterpart Chinese Patent Application No. 201280063193.4.

* cited by examiner

ARRANGEMENT FOR MOVING A MOVEABLE FURNITURE PART

BACKGROUND OF THE INVENTION

The invention concerns an arrangement for moving a moveable furniture part, in particular a drawer, comprising at least one ejection device for ejection of the furniture part from the closed position into a first open position. The at least one ejection device includes at least one force storage member, and at least one loading device for loading the at least one force storage member by a closing movement of the furniture part. Loading of the at least one force storage member is effected over a loading distance with an end point, and the at least one force storage member is completely loaded at the end point of the loading distance.

Arrangements of that kind for moving a moveable furniture part are already part of the state of the art and are described, for example, in DE 198 23 305 A1. In the known structures, the end point and the starting point of the loading distance are fixed. This means that, when the moveable furniture part is arranged in or on a furniture carcass, the end or starting point of the loading distance is at a location which is fixed relative to the furniture carcass. A disadvantage in that respect is that the furniture part has to be opened at least as far as the starting point of the loading distance, in which case that starting point can also correspond to the completely opened position of the furniture part. Therefore, the force storage member can be completely loaded by the closing movement of the furniture part. Otherwise, the ejection device is only limitedly operable.

SUMMARY OF THE INVENTION

The object of the present invention is to avoid the above-described disadvantages and to provide an arrangement for moving a moveable furniture part, that is improved over the state of the art.

To attain that object, the invention provides that the loading distance has a variable starting point. The starting point of the loading distance is established in a closing movement of the furniture part from a second open position which is greater than the first open position by the position of the furniture part at the beginning of the closing movement.

It is advantageous that this variability of the starting point of the loading distance ensures that the force storage member is always completely loaded—irrespective of how far the furniture part is opened (beyond the end point of the loading distance or the first open position). In the case of an end point of the loading distance, that is arranged at a fixed location relative to the furniture carcass—irrespective of the extension travel of the moveable furniture part—that means that the arrangement is designed so that the force for loading the force storage member is set by the starting point. If the moveable furniture part is opened little, this involves a short loading distance and a relatively high force has to be applied to completely load the force storage member in the closing movement. If in contrast the furniture part is, for example, completely opened, then there is a comparatively great loading distance available and markedly less force has to be applied to completely load the force storage member.

In an advantageous embodiment of the invention, the at least one force storage member includes a spring, preferably a leg spring. In that case, the fact that the loading distance has a variable starting point and the starting point of the loading distance is established by the position of the furniture part at the beginning of the closing movement means that, depending on the respective starting point of the loading distance, the steepness of the spring characteristic is adapted. A long loading distance involves a shallow spring characteristic, while a short loading distance involves a steep spring characteristic.

BRIEF DESCRIPTION OF THE DRAWINGS

Further details and advantageous embodiments of the invention which are defined in the appendant claims are described more fully in the specific description set forth hereinafter with reference to the Figures, in which:

FIG. 2*b* is a view inclinedly from below.

DETAILED DESCRIPTION OF THE INVENTION

It should firstly be noted that the same mode of representation (diagrammatically and from below in the perspective view) was adopted in FIGS. 4 through 15, as in FIG. 3.

Figure 1:
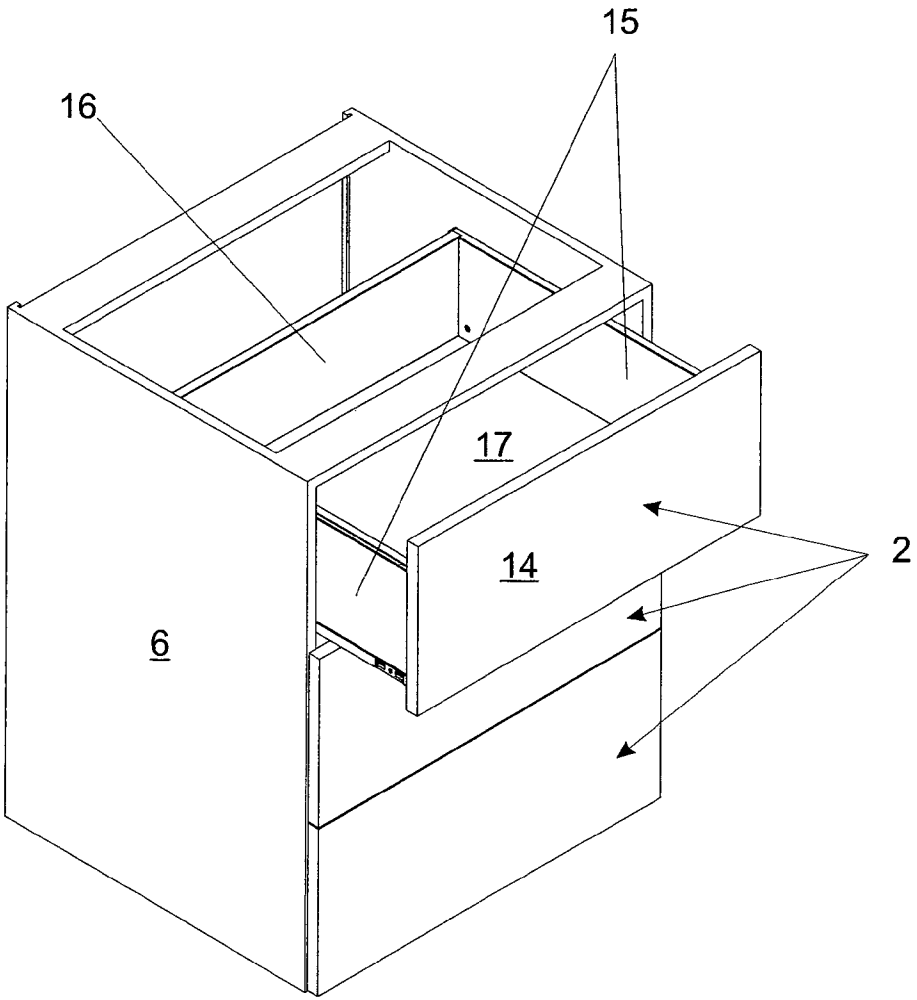
FIG. 1 is a diagrammatic perspective view of three moveable furniture parts in the form of drawers arranged in or on a furniture carcass.

FIG. 1 shows a diagrammatic perspective view of a drawer cabinet comprising a furniture carcass 6 and three furniture parts 2 in the form of drawers, mounted moveably in or on the furniture carcass 6. The drawers 2 are respectively composed of a drawer bottom 17, two side frame members 15, a rear wall 16 and a front panel 14.

Figure 2B:
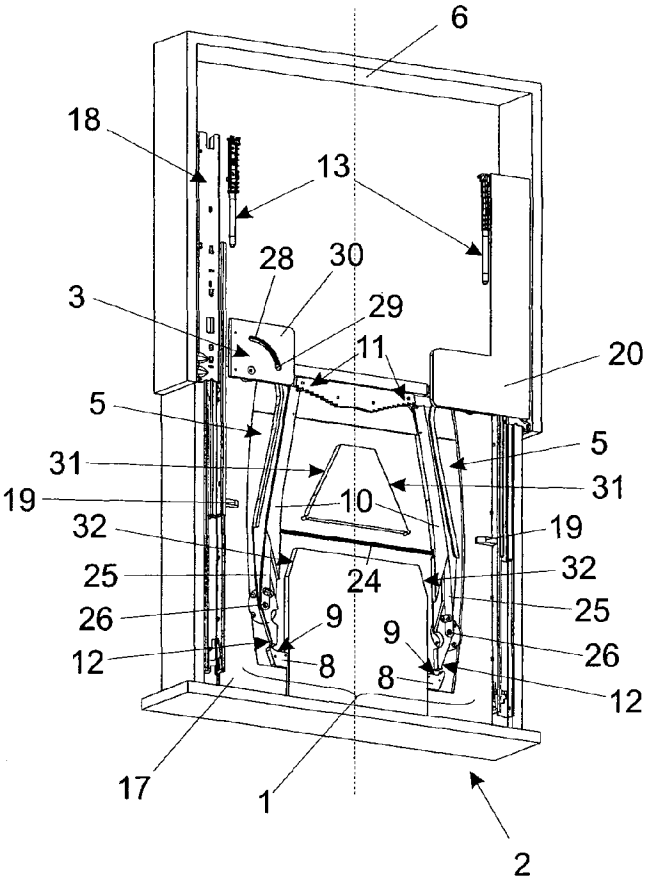
FIGS. 2*a* and 2*b* are diagrammatic perspective views of a moveable furniture part in the form of a drawer together with a part of the furniture carcass, wherein the two partial Figures differ in that FIG. 2*a* is a view inclinedly from above
Figure 2A:
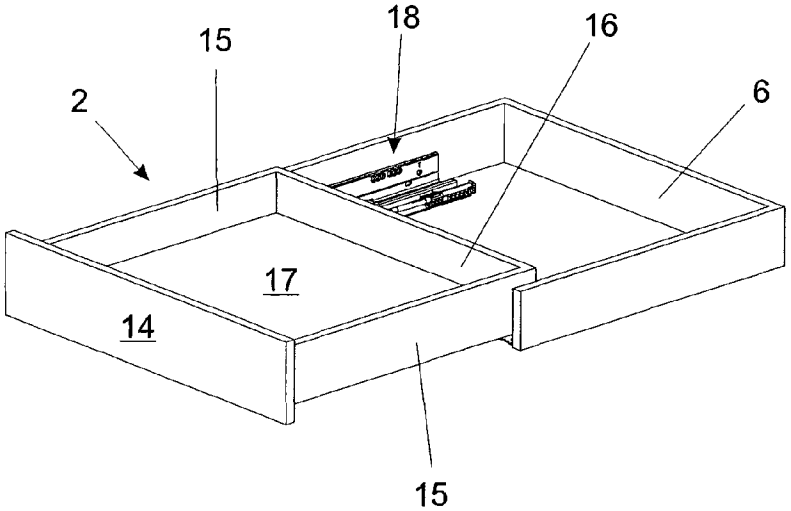

FIG. 2*a* shows a portion of the furniture carcass 6 together with a drawer 2. It will be seen that the drawer 2 is connected to the furniture carcass 6 by two extension guides 18 arranged laterally on the drawer 2 (only one of the two extension guides 18 is visible in this Figure). In the illustrated form, the extension guide 18 comprises three parts: a carcass rail fixed to a furniture carcass 6, a drawer rail fixed to the drawer 2, and a central rail mounted moveably between the drawer rail and the carcass rail. So-called full extension of drawers can be implemented by extension guides in that three-part form. Other extension guides which are part of the state of the art, however, should not be excluded from the concept of the invention.

FIG. 2*b* shows a view of the combination shown in FIG. 2*a* comprising a part of the furniture carcass 6 and a drawer 2, viewing at an incline from below. It will be seen from this view that a part of the arrangement 1 for moving a drawer 2 (in the preferred embodiment) is arranged at the underside of the drawer bottom 17 and another part of the arrangement 1 is disposed at the carcass rails of the two extension guides 18. It will further be seen that in this embodiment, the arrangement 1 comprises two halves which are in a substantially mirror-image symmetrical relationship which each other. The notional mirror axis is indicated by a broken line. The two halves each include an ejection device 3 for ejection of the drawer 2 from the closed position into an open position, that ejection device 3 at the same time also functioning as a pull-in device for pulling the drawer 2 into the closed position. In addition, the arrangement 1 also includes a damping device 13 for damping the pulling-in movement of the pull-in device 3. The damping device 13 and the pull-in device 3 are connected to the carcass rail of the extension guide 18 by an angle plate 20 (the angle plate 20 has been omitted on the left-hand side). This means that those parts of the arrangement 1 are fixedly connected to the furniture carcass 6 and upon a movement of the drawer 2 do not change their position relative to the furniture carcass 6. The other components of the arrangement 1 (in the preferred embodiment) are arranged at the underside of the drawer bottom 17 and thus upon a movement of the drawer 2 change their position relative to the furniture carcass 6.

The details of the individual components and the mode of operation of the arrangement 1 will be described more fully hereinafter with reference to FIGS. 3 through 15. Each of these figures respectively shows a plan view of the unit shown in FIGS. 2*a* and 2*b*, comprising a part of the furniture carcass 6 and a drawer 2, viewed from below. The two angle plates 20 which are actually present have been omitted, and for understanding the mode of operation of the arrangement 1, important components of the arrangement 1 that would actually not be seen as they are covered by other components are shown in broken line.

Figure 3:
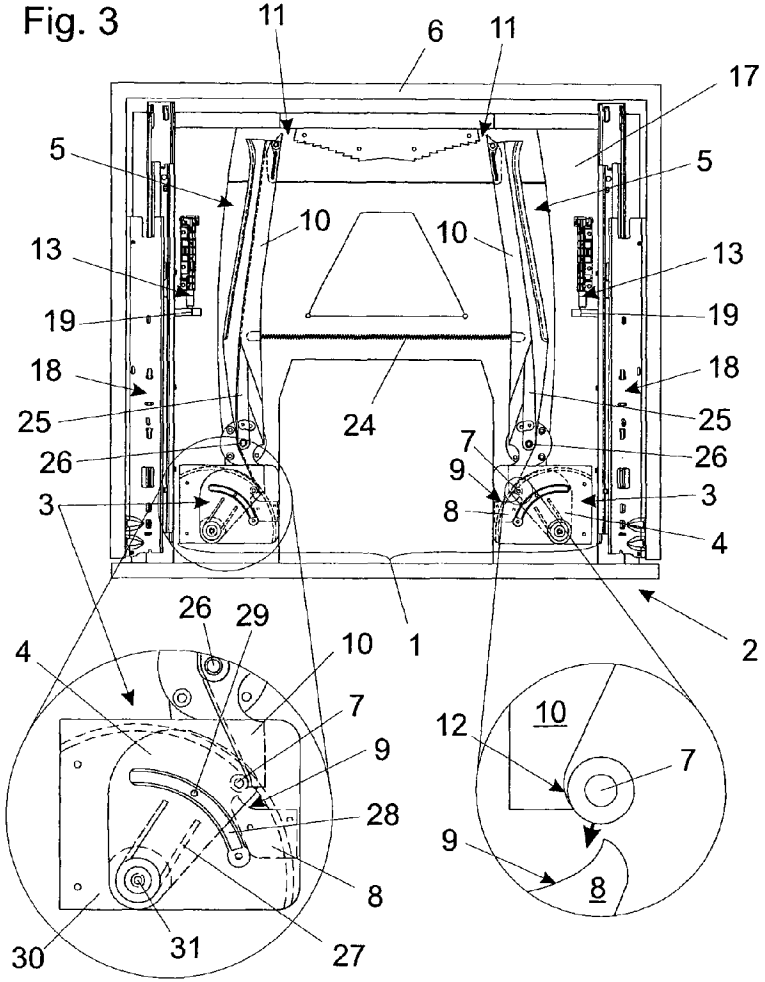
FIG. 3 is a diagrammatic view from below of the combination shown in FIGS. 2*a* and 2*b* comprising a part of the furniture carcass and a drawer, at the bottom of which the arrangement according to the invention in a preferred embodiment is disposed, the drawer being in the closed position.
Figure 7:
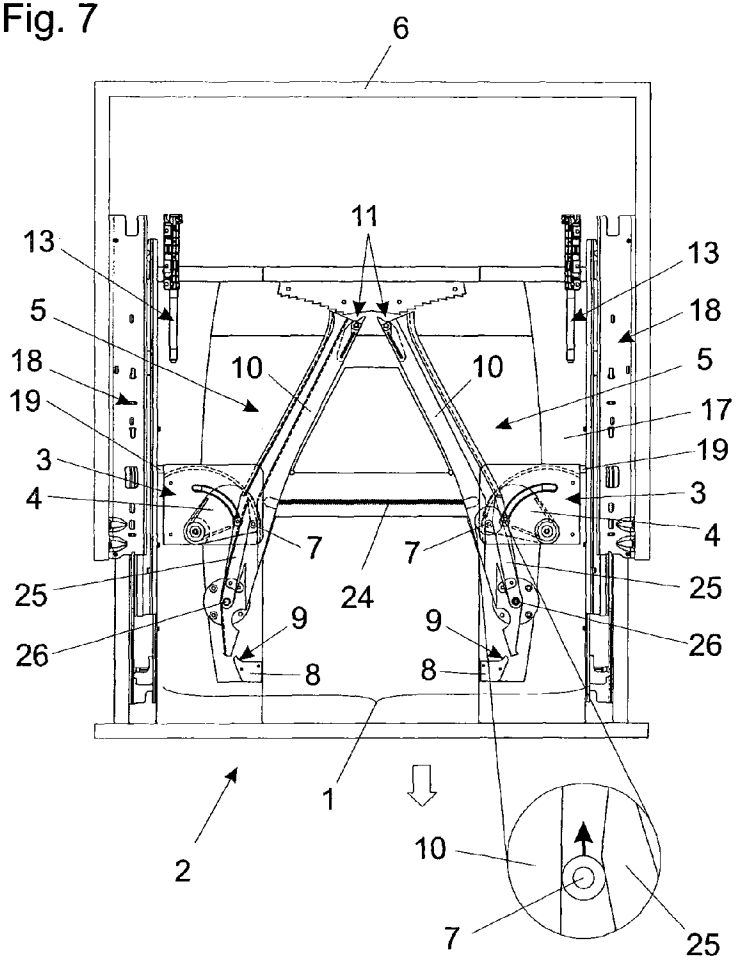
FIGS. 7 through 10 show manual opening of the drawer, following the ejection process, over a plurality of positions (FIGS. 7 through 9) until reaching the end position of the drawer (FIG. 10) in which the drawer is completely opened.

FIG. 3 shows the closed position of the drawer 2. Attention is firstly to be directed to the ejection devices 3, wherein the ejection device 3 arranged at the left-hand extension guide 18 is shown on an enlarged scale. It will be seen from this enlarged view that the ejection device 3 includes a mounting plate 30 on which is arranged a force storage member 4 mounted rotatably about an axis of rotation 31. The rotational movement of the force storage member 4 is limited by the arrangement on the force storage member 4 of a pin 29 which projects into a guide path 28 in the mounting plate 30, and that pin 29 can only move in that guide path 28. The force storage member 4 can perform only a rotational movement through about 90°, due to the configuration of the guide path 18.

The force storage member 4 includes a spring 27, more precisely a leg spring, in which the actual energy of the force storage member 4 is stored. When the pin 29 of the force storage member 4 is at the left-hand upper abutment of the guide path 28, the force storage member 4 is completely loaded. When it is at the right-hand lower abutment point it is completely unloaded.

In addition, arranged on the force storage member 4 is a pin-shaped entrainment member 7 which plays an essential part in the mode of operation of the arrangement 1. In the illustrated closed position, the entrainment member 7 ensures that the ejection device 3 is locked in the partially loaded condition (the pin 29 is disposed in a central position and the leg spring 27 is partially stressed) and the force storage member 4 cannot become unloaded. This is achieved in that, arranged at the loading device 5 which is still to be described, there is a locking device 12 in the form of a latching nose which is configured such that the entrainment member 7 of the force storage means cannot move in the direction of the unloaded position when the entrainment member 7 bears against the latching nose in the closed position of the drawer 2. That situation can be seen somewhat more precisely in the portion shown on an enlarged scale of the ejection device 3 arranged at the right-hand extension guide 18. It should also be noted that, instead of a latching nose, it is naturally also possible to use other structures which are known to the man skilled in the art, like for example a locking and unlocking path which is at least region-wise of a cardioid configuration.

Figure 4:
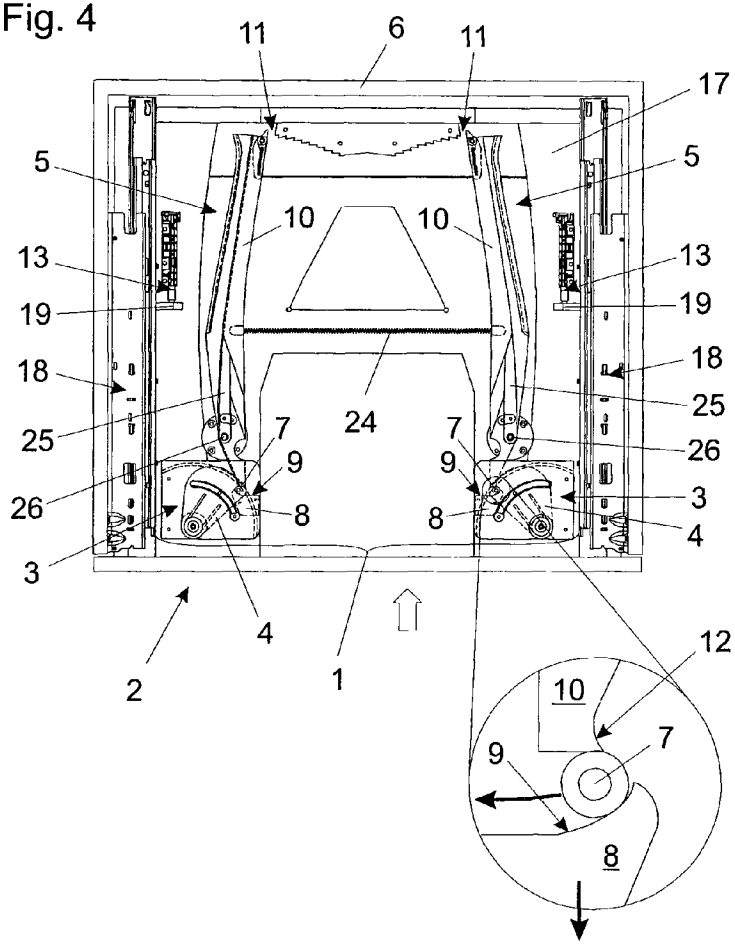
FIG. 4 shows the drawer unlocking process.

FIG. 4 shows how that locking of the ejection device 3 can be canceled by an unlocking action. Therefore, the locking device 12 at the same time also represents an unlocking device. Unlocking takes place by the drawer 2 being pushed by the user in the direction of the rear wall of the furniture carcass 6. As a result, the tip of a support device 8 arranged on the drawer bottom 17 encounters the entrainment member 7, whereby the entrainment member 7 is pressed against the latching nose (locking device) 12. It should also be noted that the latching nose (locking device) 12 is disposed at the end of a control rail 10 which the loading device 5 includes, and control rail 10 is mounted rotatably about an axis of rotation 26 whereby the position of the control rails 10 is variable in relation to the drawer 2 or the furniture carcass 6, respectively. The control rail 10 is spring-loaded by a spring 24. In the closed position, there is a force equilibrium between the spring 24 which engages the control rail 10 and the leg spring 27 of the force storage member 4, acting on the entrainment member 7. However, upon unlocking, that force equilibrium is influenced in such a way that the entrainment member 7 is pressed against the latching nose (locking device) 12. As a result, the latching nose 12 and therewith the control rail 10 pivots somewhat to the side, more specifically to such an extent that the entrainment member 7 can pass over the projection of the latching nose 12 and slip downwardly. In that way the entrainment member 7 is uncoupled from the control rail 10.

Figure 5:
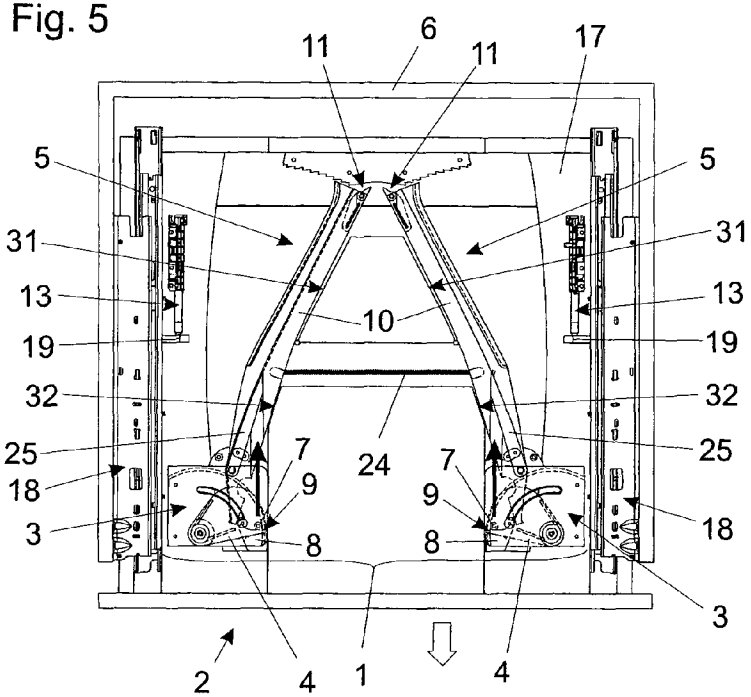
FIG. 5 shows the drawer ejection process.

FIG. 5 shows the ejection process which follows the unlocking operation and which is implemented by the ejection device 3. After unlocking, the entrainment member 7 encounters a control contour 9 which is curved region-wise and which is arranged on the support device 8, and slides along the control contour 9 as the leg spring 24 of the force storage member 4 seeks to be relieved of stress. The energy which is liberated in that case is transmitted to the support device 8 and thus to the drawer 2, which leads to an ejection movement of the drawer 2 from the closed position into a first open position. The energy transmitted by the two ejection devices 3 is sufficient to eject the drawer 2 by several centimeters (depending on the respective condition of loading of the drawer), and at least to such an extent that the user can engage under the front panel of the drawer 2 and can subsequently manually open the drawer 2. An essential aspect of such ejection devices is therefore that of being able to use drawers, on the front of which no handles have to be fitted in order to be able to open the drawers.

If FIGS. 4 and 5 are compared, it is noted that, in the ejection movement of the drawer 2, the two control rails 10 of the loading devices 5 have moved towards the drawer center and now bear against abutment contours 31 and 32. The spring 24 arranged between the two control rails 10 has relaxed in that ejection movement.

Figure 6:
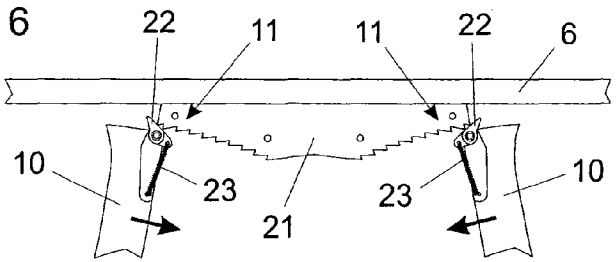
FIG. 6 shows a portion of the preferred embodiment of the invention to illustrate the mode of operation of the latching mechanism of the loading device.

If the upper end of the control rails 10 is viewed somewhat more closely, it will be seen that a small tip respectively projects in the direction of the rear wall of the drawer. The impression could arise that the movement of the two control rails 10 out of the position shown in FIG. 4 into the position shown in FIG. 5 could be impeded by those tips. If, however, FIG. 6 is considered, which shows a portion on an enlarged scale from the region of the drawer rear wall, it can be seen that the two tips are a respective arm of a double-armed tilt lever 22, wherein the other arm of the levers 22 are respectively spring-loaded by a spring 23. When now the two control rails 10 move in the direction of the drawer center, then the free arms of the levers 22 bear against the edge of a latching contour 21 which has a stepped configuration regionwise, whereby the levers 22 are tilted to the side and clear the way for the movement of the control rails 10. After the position shown in FIG. 5 is reached, the tilt levers 22 no longer bear against the latching contour 21, the springs 23 which were necessarily stressed are relieved of stress again, and the tilt levers 22 move back into their starting position under the spring force.

FIGS. 7 through 10 now show the further manual opening process for the drawer 2 by the user. In this opening process, only very low frictional forces occur as, in that opening process, only the spring 24 but not the two leg springs of the force storage member 4 are loaded. It will be apparent from the comparison of FIGS. 5 and 7 that the entrainment members 7 of the force storage member 4 firstly move into a guide path, which in this position of the control rails 10 is oriented parallel to the drawer side walls, within the control rails 10 (this is indicated by arrows in FIG. 5)—whereby they are again in coupled relationship with the control rails 10. In that case, the entrainment members 7 respectively push to the side a single-armed pivot lever 25 which is also mounted rotatably about the axis of rotation 26. That situation can be seen in the enlarged portion of the right-hand control rail 10 in FIG. 7.

Figure 8:
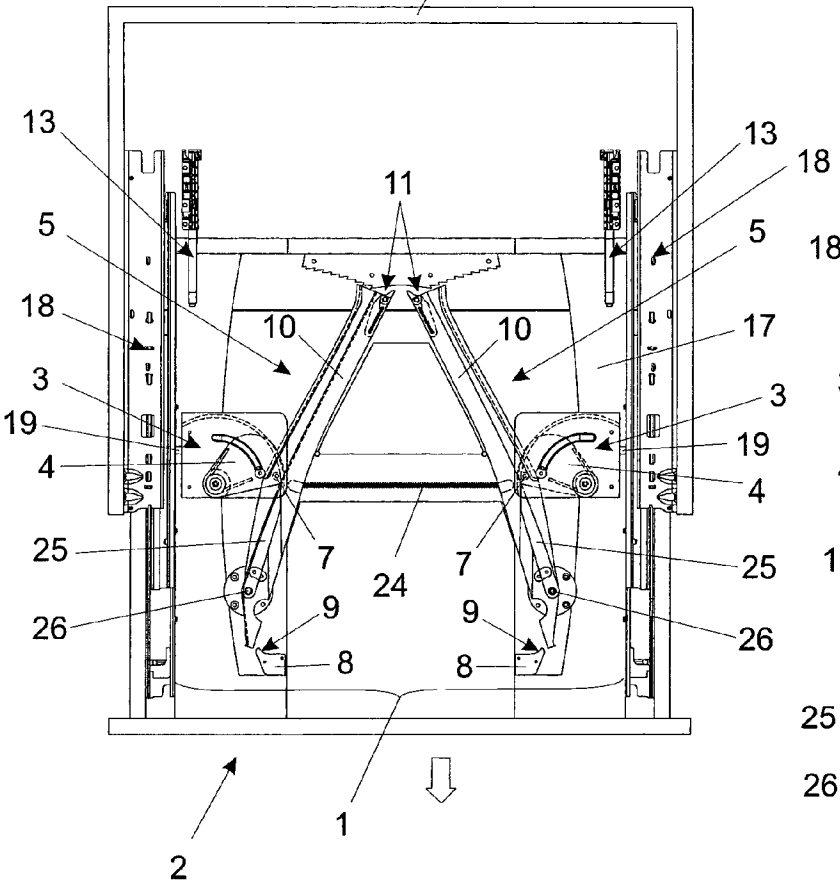

In FIG. 8, the drawer 2 is opened to such an extent that the entrainment members 7 have respectively moved beyond the pivot levers 25 and are now disposed in a second portion of the guide path of the control rails 10. It should also be noted that the two pivot levers 25 are respectively spring-loaded by a small spring (this cannot be seen) and are thereby held in a position in which the upper regions of the pivot levers 25 close the first portion of the guide path, that the entrainment members 7 first traveled. Admittedly, it is not possible to see the small spring, but it is possible to see the two spring engagement points, between which the spring is operative and which are arranged above the pivot point 26.

Figure 9:
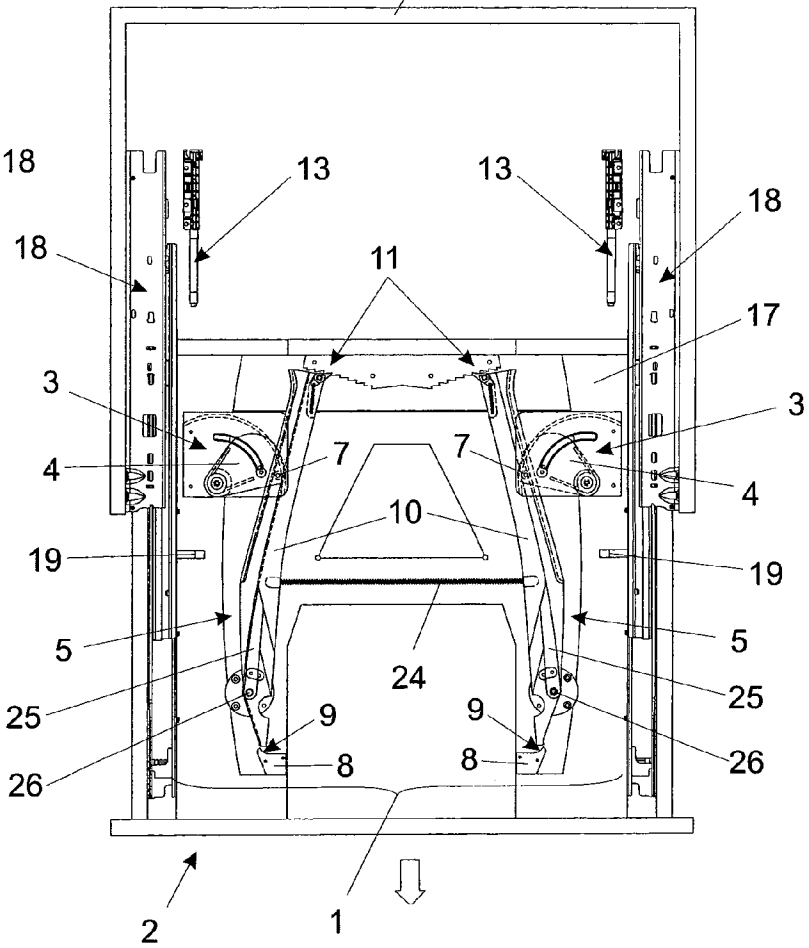

FIG. 9 shows a position of the drawer 2 in which the drawer 2 is opened somewhat further. As the ejection devices 3 are respectively connected to the carcass rail of the extension guides 8 and the force for loading the force storage member 4 is greater than the force that has to be applied to pivot the two control rails 10 in the direction of the two drawer side walls, the entrainment members 7 retain their position and force the control rails 10 to pivot outwardly (in the direction of the drawer side walls). The two tilt levers 22 (see FIG. 6) disposed at the end of the controls rails 10 are in that case tilted in the opposite direction of rotation in comparison with the movement described hereinbefore, and in that case their free arms "hop" from step to step of the latching contour 21.

Figure 10:
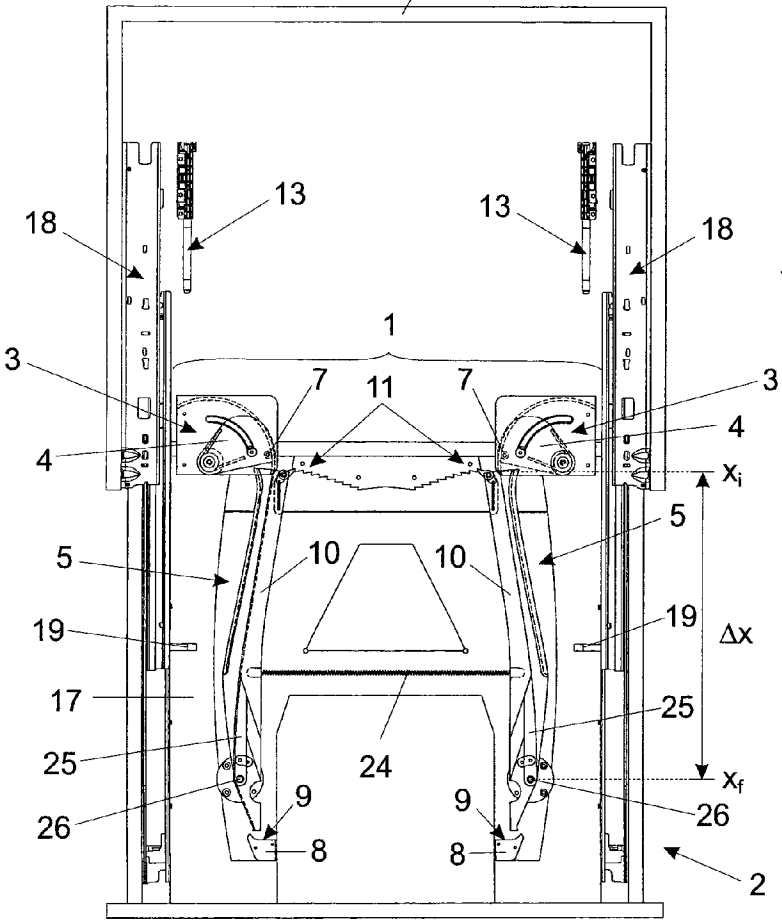

FIG. 10 shows the end position of the drawer 2 in which the drawer 2 is completely opened. In that position, the two entrainment members 7 have moved somewhat out of the second portion of the guide path in the two control rails 10. The two small tilt levers 22 arranged at the end of the two control rails 10 are respectively disposed with their free arm on the last step of the latching contour 21.

Figure 11:
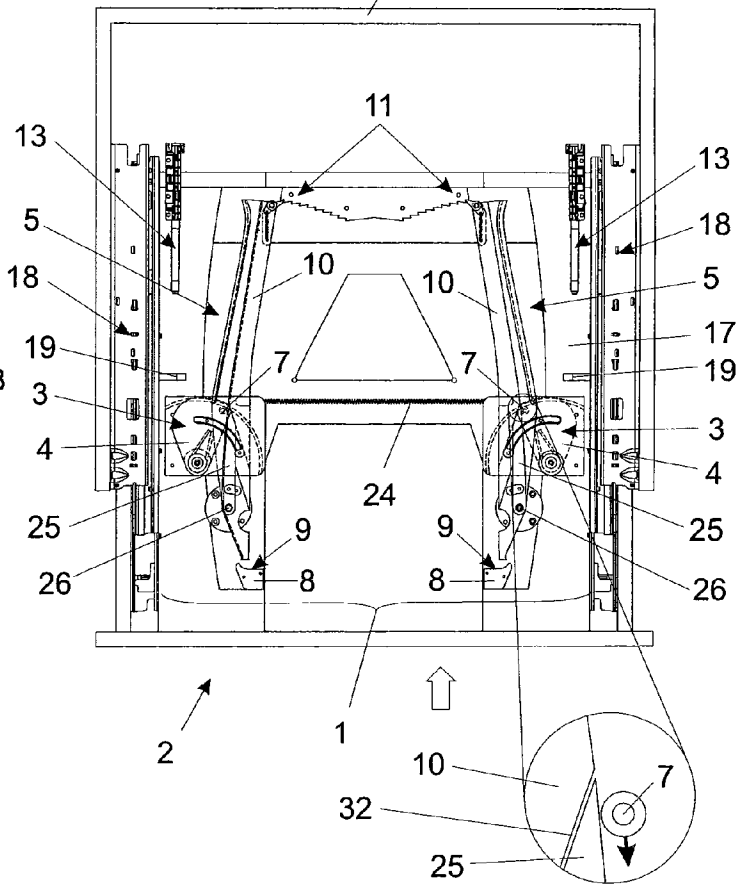
FIGS. 11 through 13 show the closing process of the drawer from the end position shown in FIG. 10 to the closed position shown in FIG. 13, and FIGS. 14 and 15 show the drawer closing process from a central position of not being completely opened.
Figure 13:
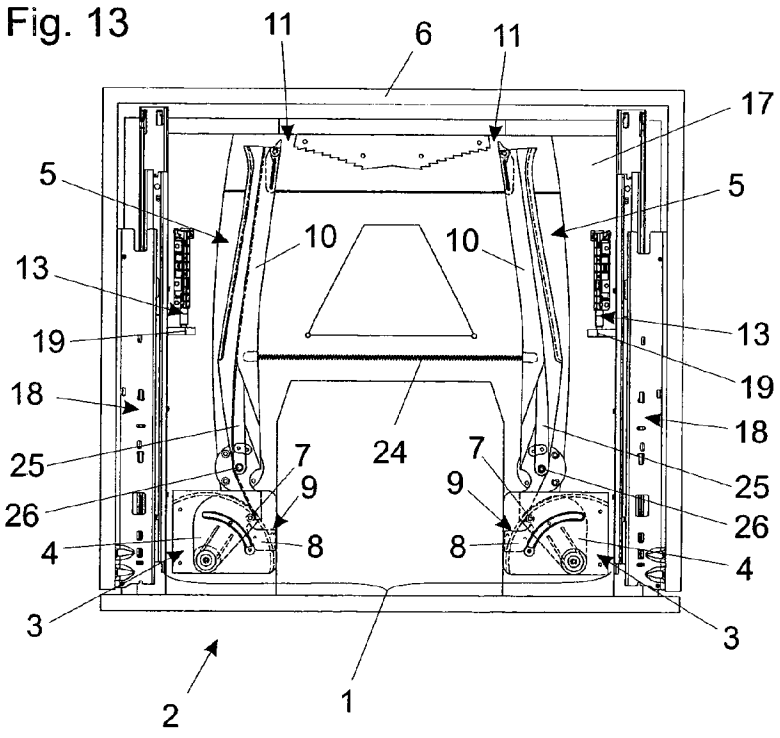
Figure 12:
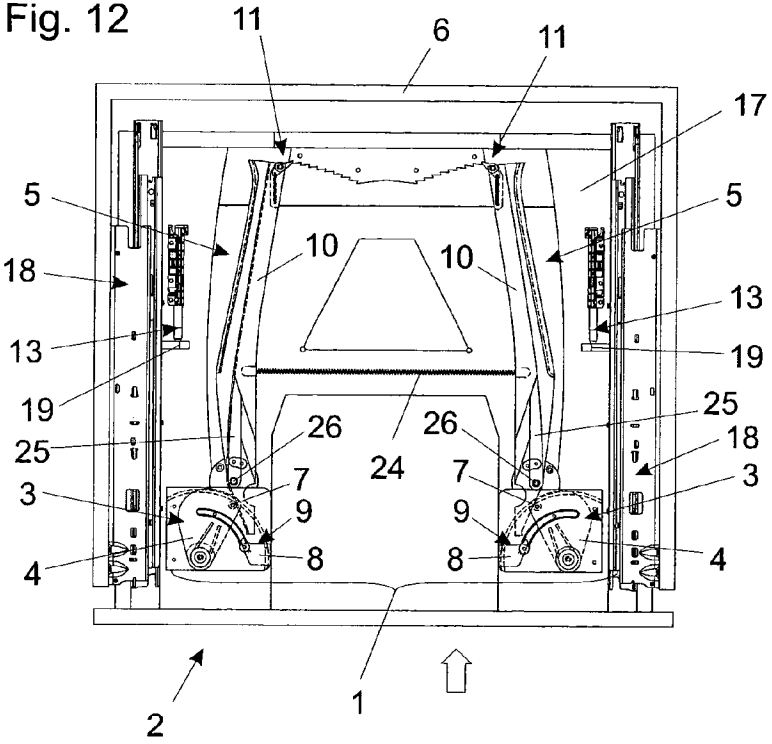

FIGS. 11 through 13 now show the closing process of the drawer 2 from the end position shown in FIG. 10, wherein that end position is a possible second open position, which is greater than the first open position. The phrase "which is greater than the first open position" therefore means that the drawer is further extended. At the beginning of the closing movement from that end position, the two entrainment members 7 firstly move back into the two guide paths of the control rails 10 again. That is facilitated by the upper second portion of the guide paths being of a slightly funnel-shaped configuration. Then the two entrainment members 2 meet the edge, that is towards the drawer center, of the guide paths of the control rails 10. Now it could be thought that in that way the control rails 10 move in the direction of the drawer center again. That, however, is not possible as the free arms of the two tilt levers 22 (see FIG. 6) still bear against the last step of the latching contour 21 and can move out of that position only by a pivotal movement of the control rails 10 in the direction of the drawer side walls, but not in the direction of the drawer center. The combination of one of the two tilt levers 22 and (a half) of the latching contour 21 in that situation therefore respectively represents a latching mechanism 11 for the two control rails 10. It is by those latching mechanisms that the position of the two control rails 10 in relation to the drawer 2 and naturally in relation to the body carcass 6 at the beginning of the closing movement and therewith also the starting point $x_i$ of the loading distance $\Delta x$, over which loading of the force storage means 4 occurs, is established. By virtue of the fact that the control rails 10 are now fixed in their position, the entrainment members 7 and thus the force storage member 4 have no other choice than to deflect in the direction of the drawer side walls and in opposite relationship to the spring force of the leg springs. In that way, a part of the energy of the translatory movement of the drawer 2 is transmitted to the force storage member 4.

A further difference between the opening and closing movements of the drawer 2 is also that the entrainment members 7 now move along those sides of the two pivot levers 25 that are towards the drawer side walls, as those pivot levers 25 are in fact pulled in the direction of the drawer center and thus against an edge 32 of the control rail 10, by the two small springs described hereinbefore. Therefore, the respective entrainment members 7 cannot move back into the first portion of the guide paths of the control rails 10. That situation can be seen by reference to the enlarged portion from FIG. 11. The end point $x_f$ of the loading distance $\Delta x$, at which the two force storage member 4 are completely loaded, is reached where the entrainment members 7 have reached the pivot point 26 of the two pivot levers 25 (see FIG. 10). In other words, the end point $x_f$ of the loading distance $\Delta x$—irrespective of the extension travel of the drawer 2—is at a location which is fixed relative to the furniture carcass 6. At that end point $x_f$ of the loading distance $\Delta x$ the leg spring of the two force storage member 4 is stressed to its maximum. Up to that end point $x_f$ which is reached about 10 cm before the closed position is reached, the user has to actively move the drawer 2. As soon as the end point $x_f$ is exceeded, the two force storage members 4 are relieved of stress somewhat again (until the closed position is reached). The drawer 2 is now automatically pulled into the closed position by the energy which is liberated. The ejection devices 3 therefore function at the same time as pull-in devices. What is also important in this connection is that the arrangement 1 in the preferred embodiment illustrated here includes a respective damping device 13 for damping the pulling-in movement of the pull-in device 3. More precisely, this involves a fluid damper in the form of a linear damper having a piston-cylinder unit, wherein that damping device 13 is connected to the carcass rail of the extension guides 18 and the furniture carcass 6 respectively, and the piston of the damper 13 bears against a projection 19 arranged laterally on the drawer rail and in that way damps the pulling-in movement. Naturally, alternative kinds of dampers which are known from the state of the art (for example rotational dampers) are not excluded from the concept of the invention. FIG. 13 shows the closed position of the drawer 2, which was also already described with reference to FIG. 3.

Figure 15:
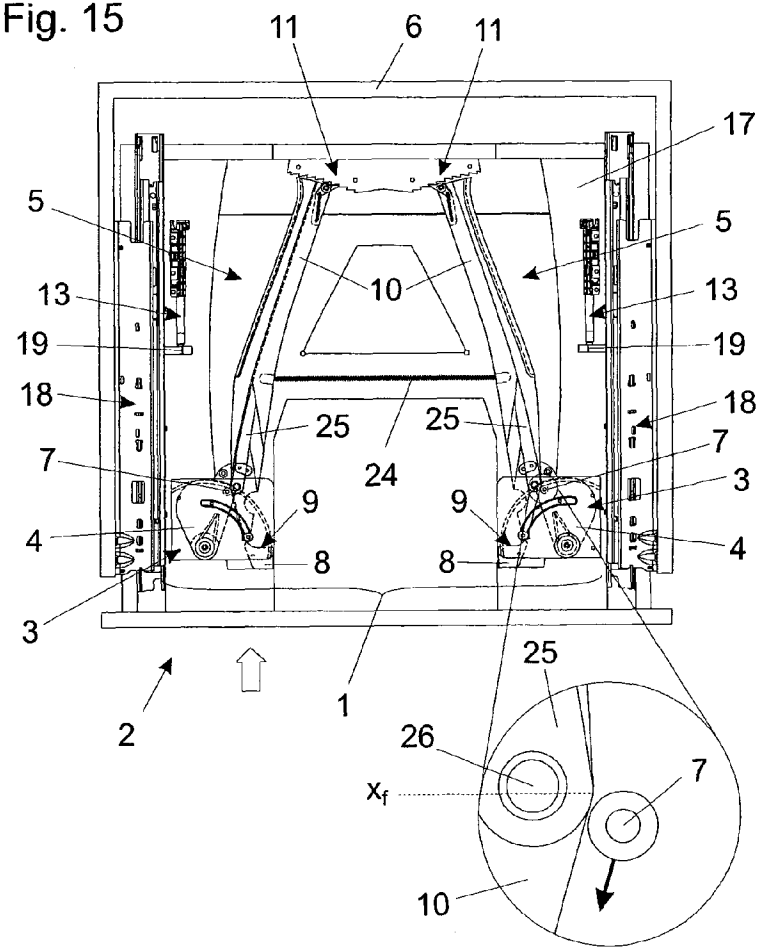
Figure 14:
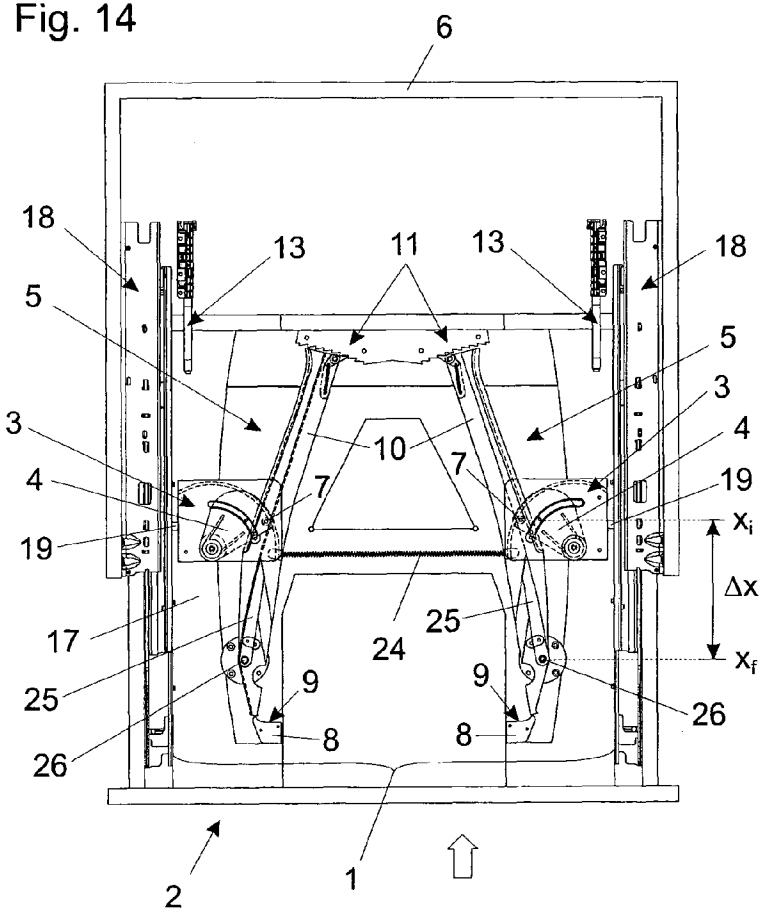

FIGS. 14 and 15 illustrate a closing movement from a central position, that is to say not completely opened, of the drawer 2, wherein that central position also represents a possible second open position of the drawer, which is greater than the first open position. During the opening process, the free arms of the two small tilt levers 22 (see FIG. 5) respectively arranged at the upper ends of the control rails 10 progressively latch on the steps of the latching contour 21. FIG. 14 shows a central position of the drawer 2, in which the free arms of the two tilt levers 22 are on the third step of the latching contour 21. If now the user wishes to close the drawer 2, the two control rails 10 latch in those two positions and thus establish the starting point $x_i$ of the loading distance $\Delta x$. If FIG. 14 is compared to FIG. 10 it will be noted that the loading distance $\Delta x$ on the one hand is very much shorter and on the other hand the angle of inclination of the control rails 10 in relation to the drawer side walls is larger. That must also be the case as now the same energy for completely loading the force storage member 4 has to be transmitted over a shorter travel, that is to say more force has to be applied by the user to close the drawer 2 or to load the force storage member 4. In general terms, therefore, the force to be applied to load the force storage member 4 is adjustable by the change in the position of the control rails 10 in relation to the drawer 2 or the furniture carcass 6, respectively.

FIG. 15 shows once again the position of the drawer 2 in which the end point of the loading distance $\Delta x$ has just been exceeded by the entrainment members 7 of the force storage member 4 and partial unloading of the force storage member 4 begins, whereby the drawer 2 is subsequently automatically pulled in.

The invention claimed is:

1. An arrangement for moving a moveable furniture part, said arrangement comprising:

an ejection device for ejecting the furniture part from a closed position into a first open position, said ejection device including a force storage member; and a loading device for loading said force storage member by a closing movement of the furniture part, said loading device being configured to load said force storage member by movement of the furniture part over a loading distance between a starting point, whereat said force storage member is unloaded, and an end point, whereat said force storage member is completely loaded;

wherein said loading device is further configured such that the starting point of the loading distance is variable, and such that loading of the force storage member always begins at the variable starting point when the furniture part is moved in a closing direction, said loading device being configured to establish the variable starting point of the loading distance upon beginning the closing movement of the furniture part at a second open position of the furniture part located further outward in an opening direction than the first open position.

2. The arrangement as set forth in claim 1, wherein said loading device is configured to establish the starting point of the loading distance by a pivotably mounted control rail configured to be fixed in different positions relative to at least one of the furniture part and a furniture carcass by the position of the furniture part at the beginning of the closing movement.

3. The arrangement as set forth in claim 1, wherein said loading device is configured such that the end point of the loading distance is at a location fixed relative to a furniture carcass and independent of an extent of movement of the furniture part.

4. The arrangement as set forth in claim 1, wherein said loading device is configured such that, during the closing movement, the end point of the loading distance is reached between 3 cm and 10 cm before the furniture part reaches the closed position.

5. The arrangement as set forth in claim 1, wherein said force storage member includes a spring.

6. The arrangement as set forth in claim 5, wherein said spring is a leg spring.

7. The arrangement as set forth in claim 1, wherein said ejection device is configured to be connected to a furniture carcass, the furniture part being arranged at or in the furniture carcass.

8. The arrangement as set forth in claim 1, wherein said ejection device has an entrainment member.

9. The arrangement as set forth in claim 8, wherein said entrainment member is pin-shaped.

10. The arrangement as set forth in claim 8, further comprising a support device for supporting said entrainment member, said ejection device being arranged at the furniture part.

11. The arrangement as set forth in claim 10, wherein said support device includes a control contour at least partially curved.

12. The arrangement as set forth in claim 8, wherein said loading device includes a control rail, said control rail being coupled to said entrainment member of said ejection device at least partially during at least one of an opening movement and the closing movement of the furniture part.

13. The arrangement as set forth in claim 12, wherein said loading device is configured such that a position of said control rail is variable relative to at least one of the furniture part and a furniture carcass connected to the furniture part.

14. The arrangement as set forth in claim 12, wherein said loading device is configured such that a force to be applied for loading said force storage member is adjustable by changing a position of said control rail relative to at least one of the furniture part and a furniture carcass connected to the furniture part.

15. The arrangement as set forth in claim 12, wherein said loading device includes a latching mechanism for establishing a position of said control rail relative to at least one of the furniture part and a furniture carcass connected to the furniture part at the beginning of the closing movement.

16. The arrangement as set forth in claim 1, further comprising a locking and unlocking device for locking and unlocking said ejection device.

17. The arrangement as set forth in claim 16, wherein said locking and unlocking device is arranged at said loading device.

18. The arrangement as set forth in claim 16, wherein said locking and unlocking device has a latching nose or a locking and unlocking path which at least partially has a cardioid configuration.

19. The arrangement as set forth in claim 18, wherein said ejection device has an entrainment member, said entrainment member being configured to bear at least partially against said latching nose or against said locking and unlocking path at least in the closed position.

20. The arrangement as set forth in claim 19, wherein said entrainment member is pin-shaped.

21. The arrangement as set forth in claim 1, wherein said ejection device is configured to serve as a pull-in device for pulling the furniture part into the closed position.

22. The arrangement as set forth in claim 21, further comprising a damping device for damping a pulling-in movement of said pull-in device.

23. The arrangement as set forth in claim 22, wherein said loading device is configured to continuously load said force storage member along the loading distance between the starting point and the end point.

* * * * *